United States Patent [19]

Hagino et al.

[11] Patent Number: 4,967,676

[45] Date of Patent: Nov. 6, 1990

[54] APPARATUS FOR DETECTING THE END OF CLOTH-OVERLAP ON A SEWING MACHINE

[75] Inventors: Seiichiro Hagino, Chiryu; Tsukasa Ando, Toyoyama, both of Japan

[73] Assignee: Aisin Seiki Kabushiki Kaisha, Kariya, Japan

[21] Appl. No.: 370,715

[22] Filed: Jun. 23, 1989

[30] Foreign Application Priority Data

Jun. 23, 1988 [JP] Japan ..... 63-155909
Jun. 23, 1988 [JP] Japan ..... 63-083374[U]
Jun. 24, 1988 [JP] Japan ..... 63-157415

[51] Int. Cl.[5] ..... D05B 69/18; G01J 1/28

[52] U.S. Cl. ..... 112/272; 112/277; 250/205

[58] Field of Search ..... 112/272, 275, 277, 121.11, 112/121.12; 250/205, 561, 571, 548

[56] References Cited

U.S. PATENT DOCUMENTS 4,696,246 9/1987 Rohr et al. ..... 112/272
4,732,095 3/1988 Saito et al. ..... 112/272 X
4,745,272 5/1988 Andreatti, Jr. ..... 250/205

*Primary Examiner*—Peter Nerbun
*Attorney, Agent, or Firm*—Oblon, Spivak, McClelland, Maier & Neustadt

[57] ABSTRACT

An apparatus for detecting a stepped portion between an upper cloth and a lower cloth on which the upper cloth is mounted, including a light-emitter for transmitting light to a light receiver. The stepped portion is detected based on a decrease in light received by the light receiver. In order to assure detection of the stepped portion, an optimum amount of light to be emitted from the light-emitter is determined so that a deviation between a transmissivity of the lower cloth and a transmissivity of both cloths arranged in a layered configuration may be maximized.

4 Claims, 7 Drawing Sheets

APPARATUS FOR DETECTING THE END OF CLOTH-OVERLAP ON A SEWING MACHINE

BACKGROUND OF THE INVENTION

1. Field of the Invention:

The present invention relates to an apparatus for detecting the end of a cloth-overlap.

2. Description of the Background:

Conventionally, in a case where an upper cloth is sewn on a lower cloth by a sewing machine, the machine has to be stopped upon detection of the end of a cloth-overlap or a stepped portion formed at a terminus of the upper cloth on the lower cloth. For detecting the end of the cloth-overlap or the stepped portion, a sensor is employed. That is to say, the sensor includes a light emitting portion, a light receiving portion opposing the light emitting portion and a controller which drives the sewing machine. The sensor is provided at an upstream side of a needle and is set on a path along which the cloths are fed by a feed-dog. When the end of the cloth-overlap or the stepped portion is brought into opposition to the light emitting portion during the feeding of both of the cloths, the amount of light is decreased, with the controller then stopping the sewing machine.

However, when both cloths are of thin thickness, a sufficient change in the amount of light sometimes cannot be received by the light receiving portion. Therefore, it is feared that the sewing machine is not stopped despite non-existence of the upper cloth on the lower cloth.

SUMMARY OF THE INVENTION

It is, therefore, a primary object of the present invention to provide an apparatus for detecting the end of a cloth-overlap without the aforementioned drawback.

The above and other objects are achieved in accordance with the present invention by providing a new and improved apparatus for detecting the end of a cloth-overlap, including a light emitter for emitting light, a light-receiver for receiving light from the light-emitter, adjusting means for adjusting the amount of light to be emitted from the light-emitter, storing means for storing plural data each of which includes a transmissivity of the lower cloth and a transmissivity of the upper cloth and the lower cloth arranged in a layered configuration, and selecting means for selecting optimum data from the plural stored data and controlling the adjusting means to adjust the amount of light to be emitted from the light-emitter to be optimum based on the selected optimum data.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
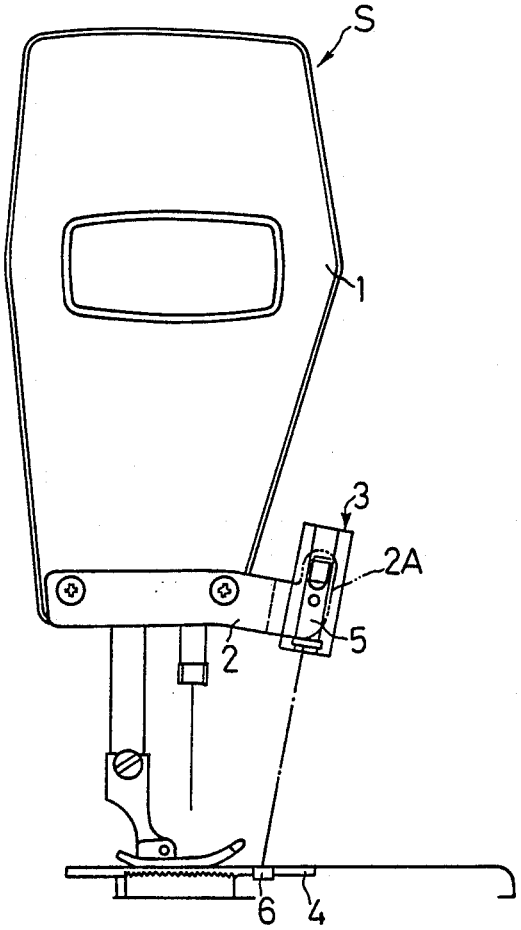
FIG. 1 is a side view of a sewing machine to which an apparatus according to the present invention is installed.
Figure 2:
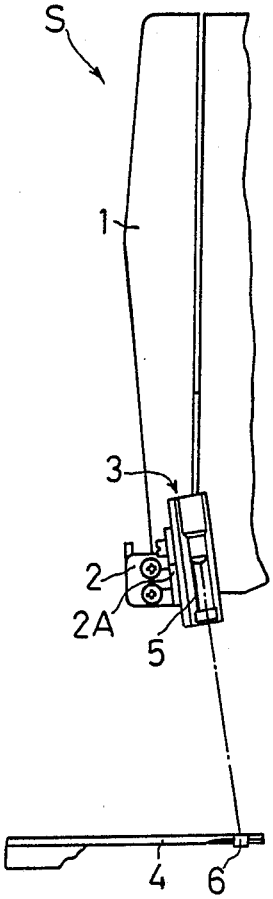
FIG. 2 is a portion of a front view of the sewing machine shown in FIG. 1.
Figure 3:
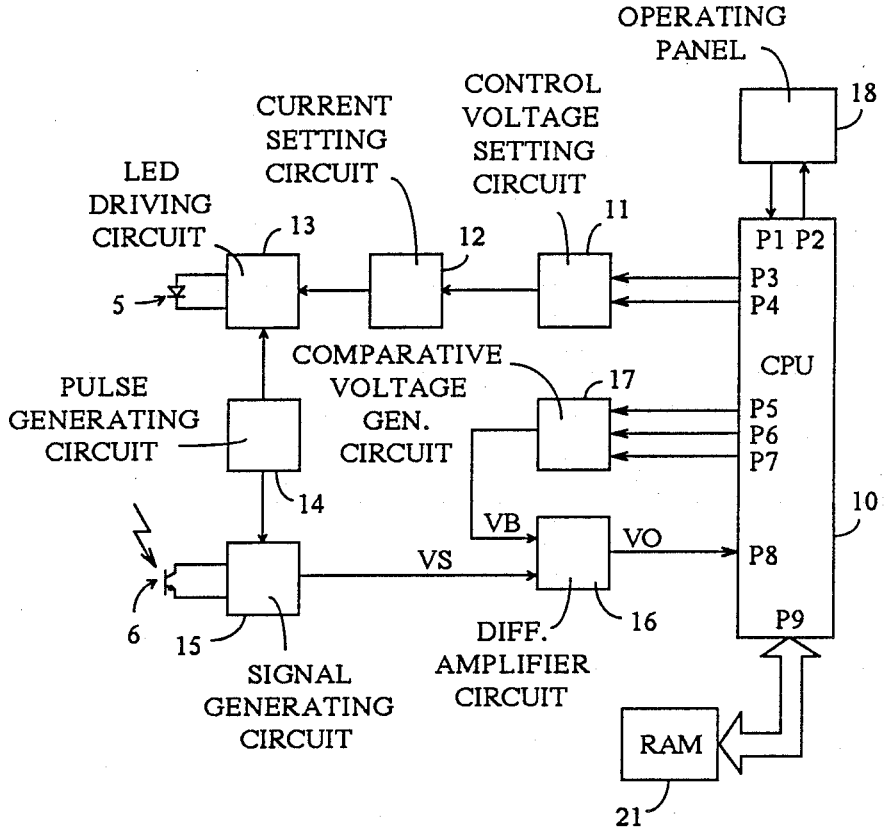
FIG. 3 is a block diagram of a circuit of the apparatus according to the present invention.

Referring now to the drawings, wherein like reference numerals designate identical or corresponding parts throughout the several views, and more particularly to FIGS. 1, 2 and 3, thereof, a bracket 2 is secured to a side plate of a sewing machine S. A sensor device includes a casing 3 which is swingably connected to the bracket 2. In the casing 3, an emitter 5 from which light is emitted to a throat plate 4 is accommodated. In the throat plate 4, there is provided a receiver 6 opposing the emitter 5 for receiving light therefrom. A controller 10 in the form of a microprocessor CPU is electrically connected to the emitter 5 and the receiver 6 so as to operate in such a manner that the sewing machine is stopped upon a change in the amount of light detected by the receiver 6. It should be noted that this function of the controller 10 is well-known.

Figure 4:
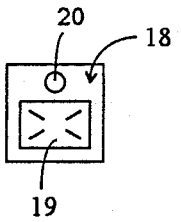
FIG. 4 is a front view of an operating panel of the apparatus of the present invention.
Figure 5:
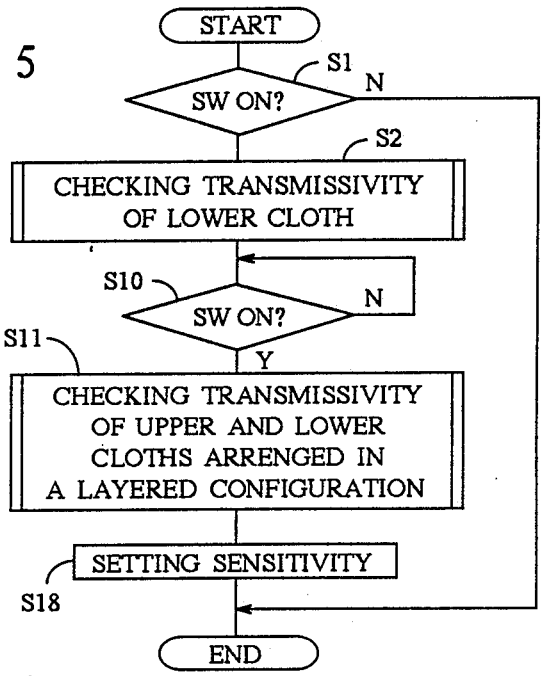
FIG. 5 is a flow chart which shows a main-routine for operating the apparatus of the present invention.
Figure 6:
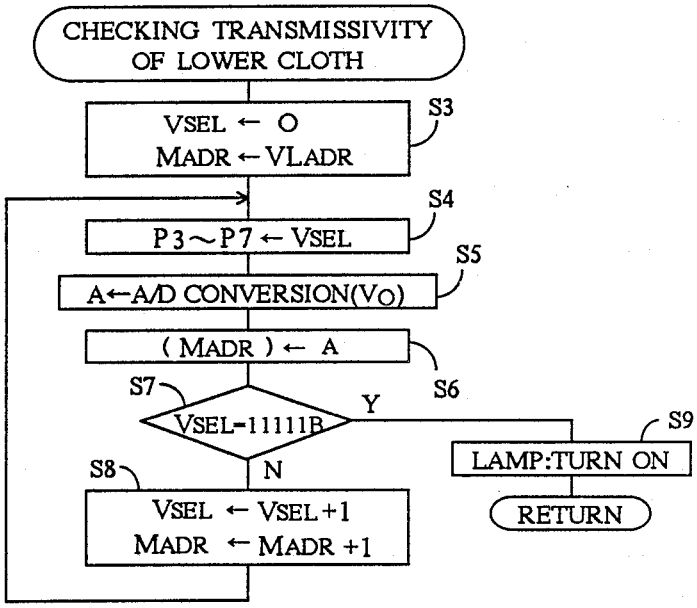
FIG. 6 is a flow-chart showing a sub-routine for checking the transmissivity of a lower cloth.
Figure 7:
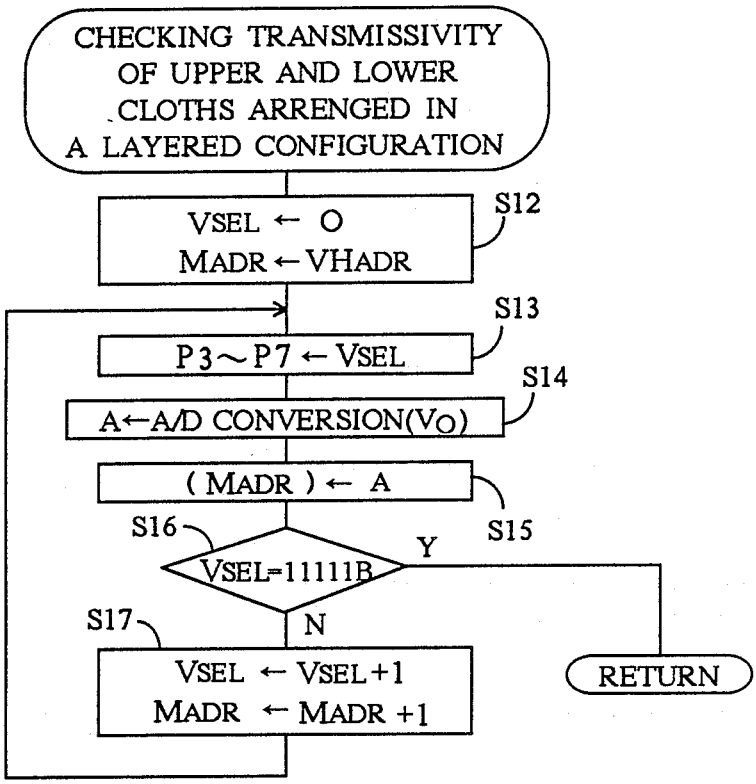
FIG. 7 is a flow-chart showing a sub-routine for checking the transmissivity of an upper cloth and the lower cloth in a layered configuration.
Figure 8:
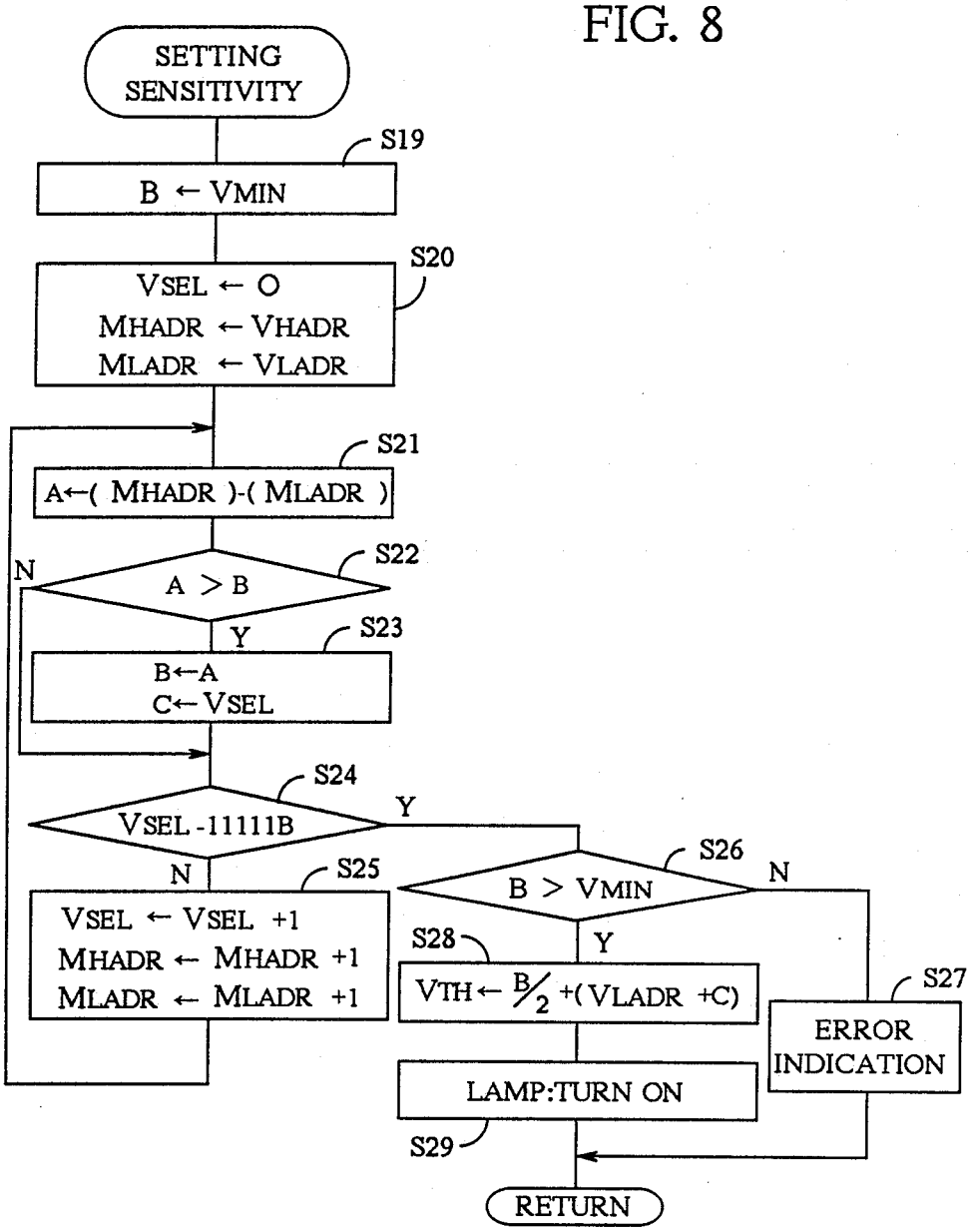
FIG. 8 is a flow-chart showing a sub-routine for setting optimal sensitivity.

As shown in FIGS. 3 and 4, ports P3 and P4 are electrically connected to the emitter 5 via a light-amount adjusting means including a control voltage setting circuit 11, a current setting circuit 12, and LED driving circuit 13 and pulse-generating circuit 14. Thus, according to the outputs of the ports P3 and P4, a number of pulses corresponding to the amount of light to be emitted from the emitter 5 is supplied to the LED driving circuit 13 from the pulse-generating circuit 14. The receiver 6 is electrically connected to differential-amplifier circuit 16 via signal generating circuit 15. Ports P5 through P7 are connected to the differential-amplifier circuit 16 via a comparative-voltage generating circuit 17. From the differential-amplifier circuit 16 to a port P8, an output VO is supplied which is a deviation between an output VR of circuitry and an output VS of the signal generating circuit 15. The output VS represents the sum or the brightness of light detected by the receiver 5 and the brightness of ambient light. The output VR represents the outputs from the ports P5 through P7 as the brightness of ambient light. Further, an operating panel 18 is connected to ports P1 and P2 so that an output indicative of a closure of a transmissivity setting switch 19 is transmitted to the port P1 and a lamp 20 is turned on or off by an output of the port P2. A port P9 is connected to a RAM 21.

Before operation of the present invention is described in detail hereinafter with reference to FIGS. 1 through 8, an outline thereof is described. In order to obtain an optimum amount of light to be emitted from the light-emitter 5 during a sewing operation, the following operation is first performed. That is to say, the transmissivity of the lower cloth and the transmissivity of the upper and lower cloths arranged in a layered configuration are first each calculated 32 times using different amounts of light. Thereafter, a deviation between each transmissivity of the lower cloth and each transmissivity of the upper and lower cloths arranged in a layered configuration at the same amount of light is calculated and the optimum amount of light resulting in a maximum deviation is obtained.

Detailed operation of the apparatus according to the present invention next described referring to FIGS. 5–8. When the switch 19 is closed (step S1), a routine for detecting the transmissivity of the lower cloth is executed (step S2). In step S3, a 5-bit flag VSEL to be inputted to the ports P3 through P7 is initialized at 0 and the contents of a register MADR is set to an address VLDAR at which is initially stored the transmissivity of the lower cloth. Thus, initialization is completed. In step S4, the content of the flag VSEL is supplied to ports P3 through P7. In step S5, the transmissivity VO corresponding to the content of the flag VSEL is inputted to a flag A. In step S6, the transmissivity VO is stored in the address VLADR in the resister MA. In step S7, a check is performed whether the flag VSEL is '11111' or not. If not, the flag VSEL is replaced with a next value and an address next to the address VLADR is established in the register MADR. Thereafter, control is returned to step S4. By repeating this operation, at each address in the register MADR, a transmissivity corresponding to a respective value of the flag VSEL is stored. If the contents of the flag is '11111', the control is returned to the main routine after lighting the lamp 20 in step S9. Thus, all sensitivities VO corresponding to the received lights at the receiver 6 are obtained when the lower cloth is disposed between the emitter 5 and the receiver 6 and are stored in the RAM 21.

When the switch 19 is closed in step S10, a routine for detecting the transmissivity of the upper cloth and the lower cloth arranged in layered configuration is performed. In step S12, 5-bit flag VSEL to be inputted to the ports P3 through P7 is initialized at 0 and the contents of the register MADR is set to an address VHADR at which is initially to be stored the transmissivity of the upper cloth arranged in layered configuration with the lower cloth. Thus, initialization is completed. In step S13, the contents of the flag VSEL is supplied to ports P3 through P7. In step S14, the transmissivity VO corresponding to the contents of the flag VSEL is inputted to the flag A. In step S15, the transmissivity VO is stored at the address VHADR in the register MADR. In step S16, a check is performed whether the flag VSEL is '11111' or not. If not, the flag VSEL is replaced with a next value and an address next to the address VHADR is established in the register MADR. Thereafter, the control is returned to step S13. By repeating this operation, in each address in the register MADR, each transmissivity corresponding to each value of the flag VSEL is stored. If the flag is '11111', the control is returned to main routine. Thus, all sensitivities VO corresponding to the received light at the receiver 6 are obtained when the upper cloth arranged in a layered configuration with the lower cloth is also disposed between the emitter 5 and the receiver 6 and are stored in the RAM 21.

At step S18, a routine for setting the sensitivity begins. In step 19, a minimum differential-sensitivity is set. In step S20, the 5-bit flag VSEL is initialized at 0, the first address VHADR of the memory at which the transmissivity of the layered upper cloth is stored is moved to the register MHADR and the first address VLADR of the memory at which the transmissivity of the lower cloth is stored is moved to the register MLADR. Thus, the initialization is completed. In step S21, a differential-transmissivity between the transmissivity of the layered upper cloth and the transmissivity of the lower cloth is calculated and is stored in the flag A. In step S22, a check is performed whether or not the resulting differential-transmissivity in the flag A is greater than the contents of the flag B. If so, in step S23, the contents of the flag B is replaced with that of the flag A and the contents of the flag VSEL is inputted in the flag C. Step S24 is performed when the result of step S22 is negative or the performance of step S23 is completed in such a manner that the flag VSEL is checked to be '11111' or not. If not, step S25, the flag VSEL is replaced with the next value, a new address next to VHADR (VLADR) is established in the register MHADR (MLADR) and the control is returned to step S21. By repeating this operation, a maximum differential-transmissivity is obtained and is inputted into the flag B. In the case where the flag VSEL is '11111', a check is performed in step S26 to determine whether or not the value of the flag B is greater than the minimum-transmissivity VMIN. If not, an error indication is established in step S27. If so, the mid value of the differential-transmissivity calculated in step S28 is stored in the flag VTH. In step S29, the lamp 20 is lit.

As apparent from the above-mentioned description, the sensing ability of the sensor means 3 can be set at an optimum condition wherein the differential-transmissivity is at a maximum condition and the sensor means 3 can operate regardless of the thickness or color of each cloth.

Figure 9:
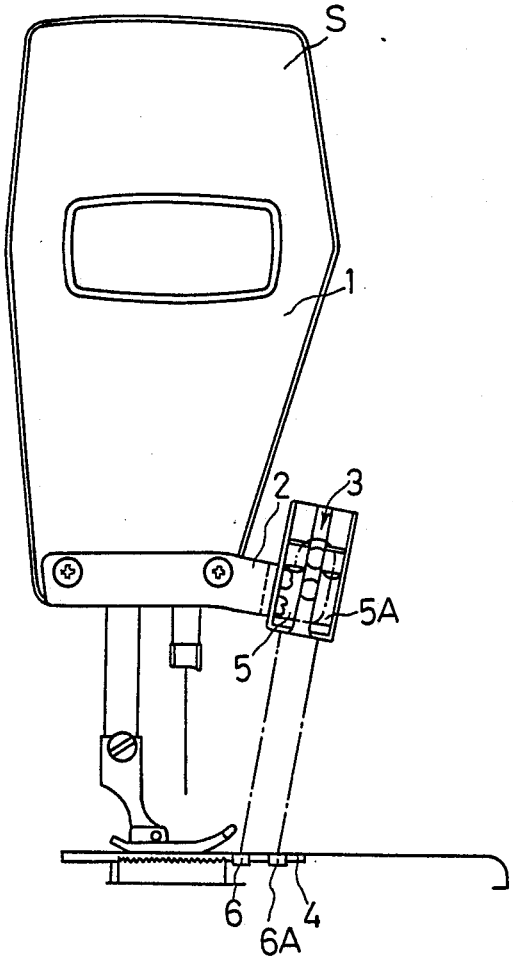
FIG. 9 is a side view of a sewing machine including an apparatus according to a second embodiment of the present invention.
Figure 10:
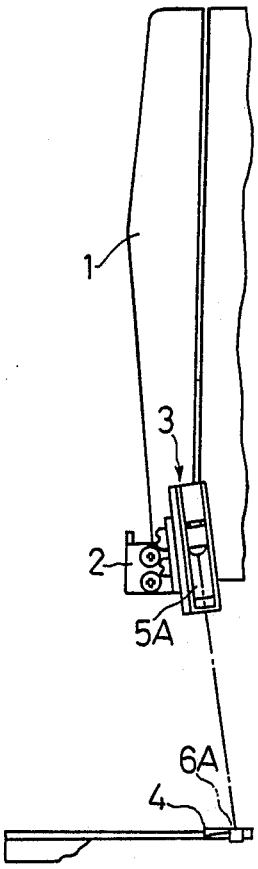
FIG. 10 is a pattern of a front view of a sewing machine to which the second embodiment of the present invention is applied.
Figure 11:
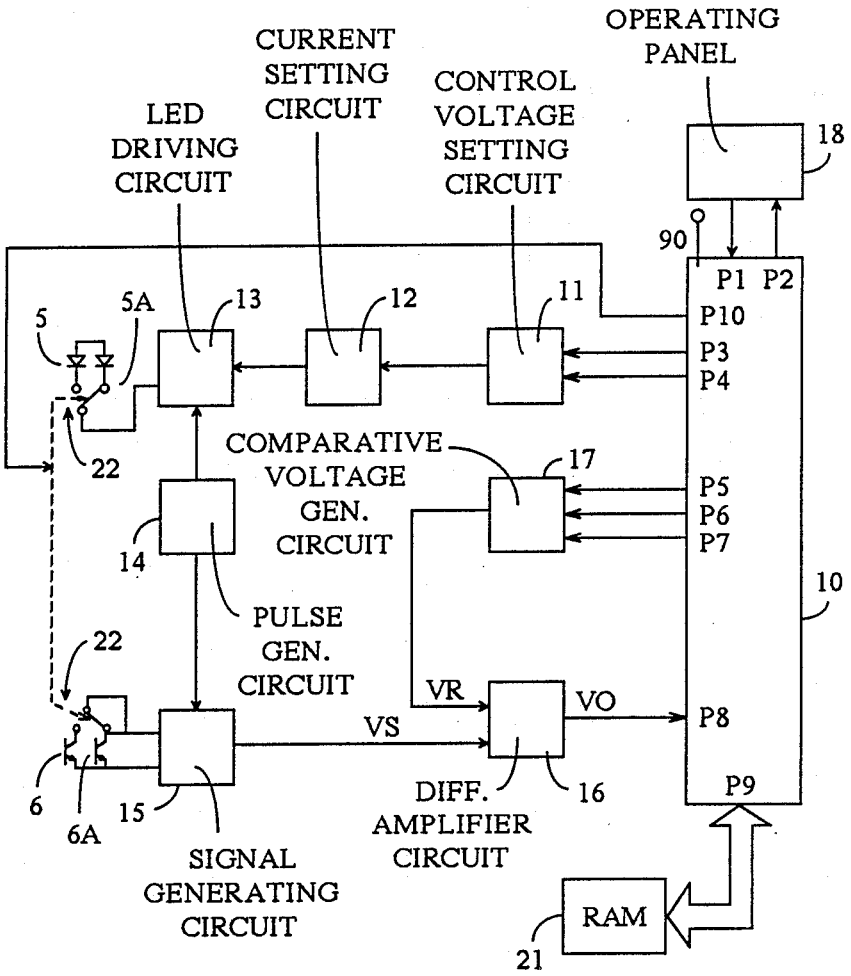
FIG. 11 is a block diagram of a circuit of the apparatus according to the second embodiment of the present invention.

In a case where the sewing machine S is provided with a light-emitter 5A and a light-receiver 6A in addition to the light-emitter 5 and the receiver 6 as shown in FIGS. 9 through 11, the above-mentioned procedure is performed for each light-emitter. That is to say, when a switch 22 connects the light-emitter 5 (the light-emitter 5A) to the circuit 13 and the light-receiver 6 (light-emitter 6A) to the circuit 15 according to a signal in the form of '0' ('1') from a port 10, the above-mentioned procedure is performed for the light-emitter 5 (the light-emitter 5A). The change of the signal from the port 10 is a result of the operation of a switch 90.

Obviously, numerous modifications and variations of the present invention are possible in light of the above teachings, it is therefore to be understood that within the scope of the appended claims, the invention may be practiced otherwise than as specifically described herein.

What is claimed as new and desired to be secured by Letters Patent of the United States is:

1. An apparatus for detecting the end of cloth-overlap of an upper cloth and lower cloth, comprising:

a light-emitter swingably mounted on a sewing machine for emitting light;

a light-receiver for receiving light from said light-emitter;

adjusting means for adjusting the amount of light to be emitted from said light-emitter;

storing means for storing plural data each of which includes a transmissivity of the lower cloth and a transmissivity of the upper cloth and the lower cloth arranged in a layered configuration; and selecting means for selecting optimum data from said plural stored data and controlling said adjusting means to adjust the amount of light to be emitted from said light-emitter to be optimum based on the selected optimum data.

2. An apparatus according to claim 1, wherein said selecting means comprises:

means for calculating a deviation between the transmissivity of the upper cloth and the lower cloth arranged in a layered configuration and the transmissivity of said lower cloth for each of said stored data and selecting a maximum deviation from the deviations calculated on said optimum data.

3. An apparatus according to claim 2, wherein said transmissivity of lower cloth and said transmissivity of the upper and lower cloths arranged in a layered configuration are each calculated a plurality of times using different intensities of light prior to calculating the deviation between each of said transmissivities.

4. An apparatus for detecting the end of cloth-overlap of an upper cloth and lower cloth, comprising:

a light-emitter for emitting light;

a light-receiver for receiving light from said light-emitter;

adjusting means for adjusting the amount of light to be emitted from said light-emitter;

storing means for storing plural data each of which includes a transmissivity of the lower cloth and a transmissivity of the upper cloth and the lower cloth arranged in a layered configuration; and selecting means for selecting optimum data from said plural stored data and controlling said adjusting means to adjust the amount of light to be emitted from said light-emitter to be optimum based on the selected optimum data, including means for calculating a deviation between the transmissivity of the upper cloth and the lower cloth arranged in a layered configuration and the transmissivity of said lower cloth for each of said stored data and selecting a maximum deviation from the deviations calculated on said optimum data;

wherein said transmissivity of lower cloth and said transmissivity of the upper and lower cloths arranged in a layered configuration are each calculated a plurality of times using different intensities of light prior to calculating the deviation between each of said transmissivities.

* * * * *